US005097747A

United States Patent [19]

Levenez

[11] Patent Number: 5,097,747

[45] Date of Patent: Mar. 24, 1992

[54] PILOT ADJUSTER-CONNECTOR FOR ADJUSTING THE SPEED OF PNEUMATIC PRESSURE CYLINDERS

[75] Inventor: Yves Levenez, Rue de la Baste, France

[73] Assignee: Legris S.A., Rennes, France

[21] Appl. No.: 474,718

[22] PCT Filed: Sep. 13, 1989

[86] PCT No.: PCT/FR89/00462

§ 371 Date: Apr. 5, 1990

§ 102(e) Date: Apr. 5, 1990

[87] PCT Pub. No.: WO90/02883

PCT Pub. Date: Mar. 22, 1990

[30] Foreign Application Priority Data

Sep. 16, 1988 [FR] France ..... 88 12409

[51] Int. Cl.[5] ..... F15B 11/08

[52] U.S. Cl. ..... 91/463; 91/443; 137/599; 137/854; 251/60; 251/122

[58] Field of Search ..... 91/443, 463; 137/599, 137/854; 251/60, 122, 285

[56] References Cited

U.S. PATENT DOCUMENTS

| | | | |
|---|---|---|---|
| 3,090,398 | 5/1963 | Adams | 137/491 |
| 4,073,311 | 2/1978 | McGeachy | 91/443 X |
| 4,132,153 | 1/1979 | Grotness et al. | 91/443 X |
| 4,192,346 | 3/1980 | Iizumi | 91/443 X |
| 4,421,292 | 12/1983 | Matsui et al. | 251/60 |
| 4,432,385 | 2/1984 | Legris | 91/443 X |
| 4,601,366 | 7/1986 | Blain | 91/443 X |
| 4,619,287 | 10/1986 | Hama et al. | 137/854 X |
| 4,741,249 | 5/1988 | Legris | 91/443 |

FOREIGN PATENT DOCUMENTS

| | | |
|---|---|---|
| 2343280 | 9/1970 | France . |
| 2032581 | 5/1980 | United Kingdom . |

*Primary Examiner*—Edward K. Look
*Assistant Examiner*—Todd Mattingly
*Attorney, Agent, or Firm*—Roland Plottel

[57] ABSTRACT

The invention discloses a controlled connector-adjuster permitting two different speeds in the same stroke of a double-acting pneumatic pressure cylinder.

In the absence of a control signal at the orifice (13) of the apparatus, the escape pressure from the cylinder (30) effecting its rod extension stroke, finds the return valve (14) closed and holds the piston (2) against the stop (9) whose adjustment defines a first flowrate between the needle valve (15) at the end of the piston and its seat (16), which flowrate corresponds to the high speed. The arrival of a pressure signal into the chamber (6) causes piston (2) to move until it abuts on a second screw (7) whose adjustment permits a second smaller flowrate than the first one and which thus determines the second speed. The return valve (14) opens to the intake flow passing through the apparatus in the opposite direction towards the cylinder in its return stroke and with the pilot signal having disappeared, this pressure pushes the piston (2) back into the high speed position.

8 Claims, 2 Drawing Sheets

PILOT ADJUSTER-CONNECTOR FOR ADJUSTING THE SPEED OF PNEUMATIC PRESSURE CYLINDERS

FIELD OF THE INVENTION

BACKGROUND OF THE INVENTION

The invention relates to apparatus in which the speed of a double-acting pneumatic cylinder is adjusted for each travel direction by means of a unidirectional flow limiter placed between the orifice of the pressure cylinder through which the air escapes during the adjusted stroke and its directional control valve. Such an apparatus, also called adjuster, comprises an adjustment screw fast with a needle-valve for limiting at will the flow of air escaping through its seat which thus determines the speed of the cylinder. So that, in the other travel direction, the drive fluid is admitted at full flow into this same chamber, the adjuster further comprises a unidirectional valve opening in the direction of the intake flow and closing in the direction of the escape flow. Conventional adjusters only allow a single adjusted speed for one travel direction of the pressure cylinder, which speed is established at the outset and remains constant. Now, in a large number of cases, it would be desirable to have, during each stroke and on demand, two speeds of different values, which would increase the operating rates while avoiding end of travel shocks, or else allowing a rapid speed of a tool to be readily obtained followed by a slower working speed.

The present invention makes it possible to attain this aim, by providing two-speed adjusters, the passage from one speed to a second adjusted lower speed being achieved by a pneumatic control signal arriving in the apparatus and the reverse operation by disappearance of this signal.

Various prior art arrangements are known including these as follows:

| | | |
|---|---|---|
| Adams | 3,090398 | |
| Britain | 2,032,581 | |
| France | 2,343,280 | (U.S. Pat. No. 4,214,607 and U.S. Pat. No. 4,171,007) |
| France | 2,363,015 | (U.S. Pat. No. 4,287,812 and U.S. Pat. No. 4,192,346) |

These patents or known prior uses teach and disclose various types of valve metering systems of various sorts and of various manufactures and the like as well as methods of their construction, but none of them whether taken singly or in combination disclose the specific details of the combination of the invention in such a way as to bear upon claims of the present invention.

SUMMARY OF THE INVENTION

According to the invention, a controlled connector-adjuster comprises three connectable orifices; the first orifice is connected to one of the orifices of the pressure cylinder through which the air leaves in the direction of the stroke whose speed it is desired to adjust; the second orifice is connected to the corresponding orifice of the directional control valve and the third orifice is connected to a control pipe. The air escaping from the pressure cylinder during the stroke flows from the first to the second orifice and its flowrate through a seat depends on the position of a needle-valve which controls the flow section thereof. This needle-valve is formed by the end of a piston sliding sealingly by means of a seal in its cylindrical housing and which may be subjected, on its face opposite the needle-valve, to the pressure of a signal coming from outside. This signal causes the piston to move in the direction of the seat and since this stroke is limited by the internal end of a screw which can be operated from outside against which it abuts by its needle-valve end, the flowrate of the escaping air passing through the apparatus, and so the speed of the pressure cylinder, thus depends on the adjustment of this screw. In this simplified version of the apparatus, in the absence of the control signal, the pressure passing through the adjuster in one direction or the other pushes the piston back fully into the opening of the seat and such an apparatus only allows a single adjusted speed introduced by a control signal. In preferred versions of application of the invention, the stroke of the piston on opening the seat may also be limited by a second adjustment screw opposite the first one, against which it abuts by its end opposite the needle-valve; this second screw adjusting a pressure cylinder speed always higher than that adjusted by the first one which determines the flow section through the seat in the presence of a control signal. In order then to allow full intake flow towards the cylinder during its return stroke, which flow passes through the adjuster in a direction opposite that of the controlled escape flows, a return valve is disposed to by-pass the seat and open in the direction of air intake towards the pressure cylinder and close in the direction of the bleed flow coming therefrom.

DESCRIPTION OF THE SEVERAL FIGURES OF THE DRAWING

Other features and advantages of the invention will be better understood from the following description of several preferred embodiments with reference to the accompanying drawings.

DETAILED DESCRIPTION OF THE PREFERRED EMBODIMENTS

Figure 1:
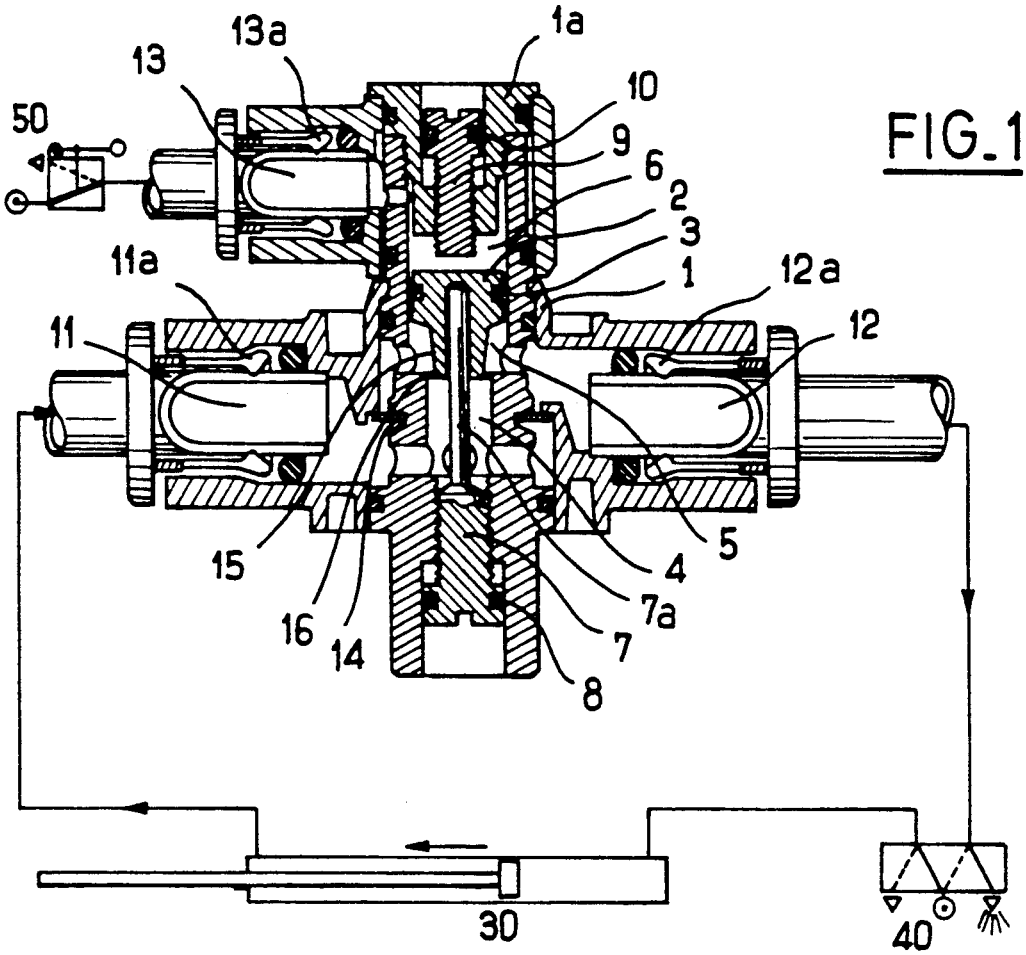
FIG. 1 is a sectional view of a controlled connector-adjuster and mounting thereof for obtaining two different extension speeds of the rod of a pressure cylinder.

In FIG. 1, the controlled adjuster comprises, in a body 1, a piston 2 sliding sealingly in a cylindrical housing by means of a seal 3 and one end of which forms a needle valve 15 cooperating with a seat 16 for controlling the rate of fluid flow from a first chamber 4 to a second chamber 5. The first chamber 4 is defined by its seat 16, an annular unidirectional valve 14 by-passing said seat, the seal 8 of an adjustment screw 7 and a connection orifice 11. The second chamber 5 is defined by its seat 16, valve 14, the seal 3 of piston 2 and a connectable orifice 12. Valve 14 is oriented so as to close and shut off the fluid flow from chamber 4 to chamber 5 and open in the opposite direction. The apparatus also comprises a third chamber 6 defined by seal 3 of piston 2, a plug 1*a* closing the housing of said piston, the seal 10 of an adjustment screw 9 in plug 1*a* and a connectable orifice 13.

Such as shown in FIG. 1, the controlled adjuster adjusts the low extension speed of the rod of a pressure cylinder 30 by the effect of a control signal delivered by a sensor 50. The air from the chamber of the pressure cylinder vented on the rod side, flows into the adjuster from its orifice 11 to its orifice 12, closes valve 14 to its own passage which can only take place through seat 16 with a flowrate depending on the position of needle valve 15. With chamber 6 pressurized, piston 2 is pushed in abutment against the internal end 7*a* of screw 7 which passes through seat 16 and penetrates into a blind axial channel of piston 2 and improves guiding thereof. In the presence of the control signal, the speed of pressure cylinder 30 is therefore adjusted by screw 7. In the absence of this signal, piston 2 is held in the open position of seat 6 by the effect of the pressure passing through the apparatus into chamber 5. The flow section left for the flow escaping through seat 16 then depends on the adjustment of screw 9 against the internal end of which piston 2 abuts by its face opposite needle valve 15. Screw 9 adjusts then a cylinder speed which is always greater than that adjusted by screw 7. With the cylinder effecting its return stroke, the intake air passing through the adjuster from orifice 12 to orifice 11 opens valve 14 and the full flow is thus ensured, whether the control signal is present or not at orifice 13 and independently of the adjustment of screws 7 and 9. Sensor 50 may be operated either manually, or by the rod of the pressure cylinder 30 itself or that of another pressure cylinder. The signal may also come from different sources, such as a timer, the start-up of another cylinder, sequencer, etc . . . It may be emitted only for some operating sequences of the pressure cylinder in the cycle.

Figure 2:
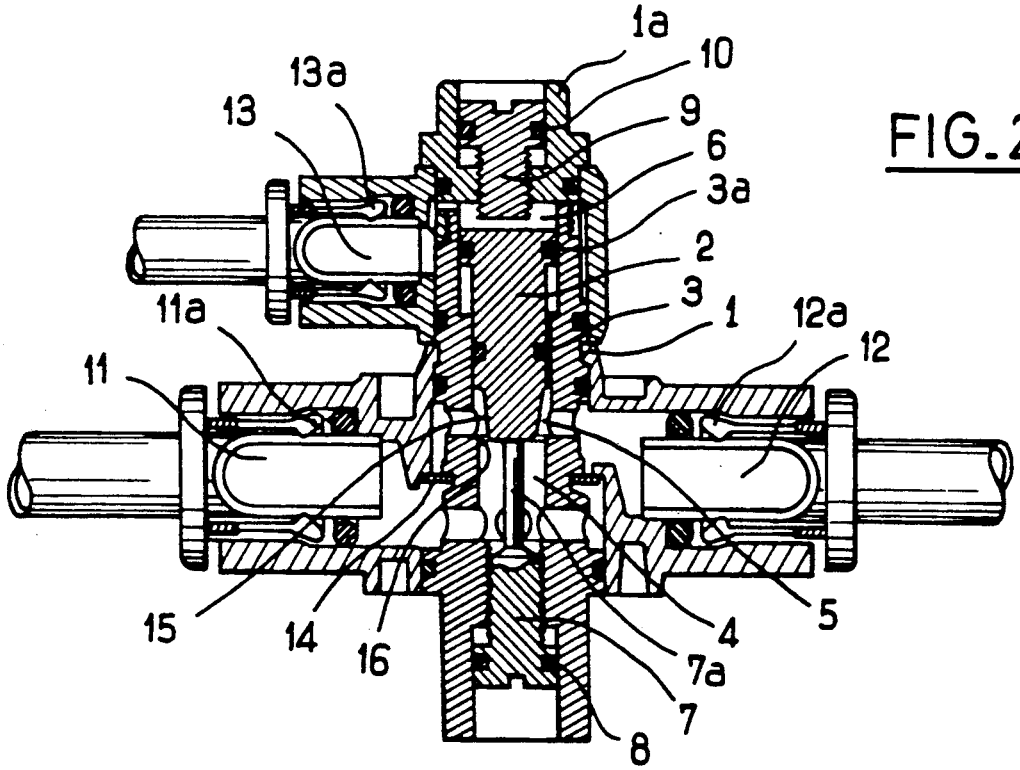
FIG. 2 is a section view of another embodiment of the invention also according to a preferred embodiment thereof.

FIG. 2 shows in section another embodiment of the invention which differs essentially from the embodiment described above in connection with FIG. 1 by its piston 2 which comprises two different sections defined by seals 3 and 3*a* which it carries. Seal 3*a*, of a larger diameter than that of seal 3, is subjected to the pressure of the signal in chamber 6; such an arrangement making it possible to use a control signal of possibly low pressure.

Figure 3:
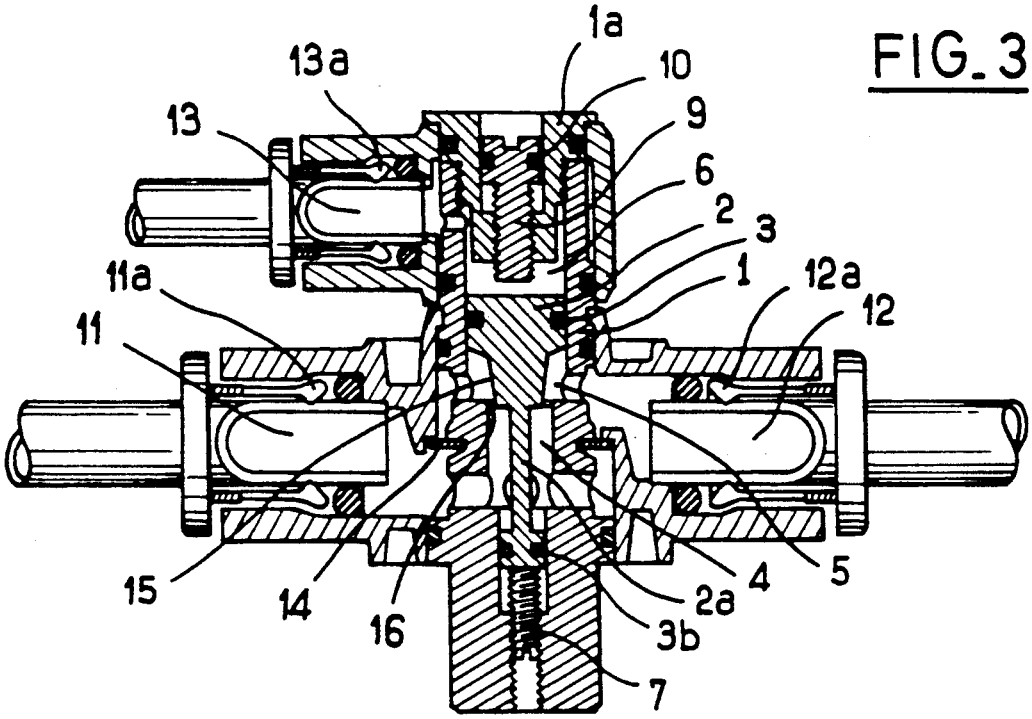
FIG. 3 is a section view of another embodiment of the invention.

FIG. 3 shows in section another embodiment of the invention which, like the embodiment described above in connection with FIG. 2, comprises a stepped piston 2 movable under the effect of a low control pressure. In FIG. 3, the needle valve 15 of piston 2 is extended by a rod 2*a* of small diameter which passes through seat 16 and comprises at its end a piston section defined by its seal 3*b* which is smaller than that of the seat and that of the large section of the piston defined by seal 3. The pressure passing through the apparatus acts on piston 2 in the direction opening seat 16 with a force resulting from the difference of sections 3-3*b*, whereas the antagonistic pressure of the signal acts on the full section 3. In this arrangement also the adjustment screw 7 for the low speed on the internal end of which piston 2 abuts by its small section, comprises no seal.

Figure 4:
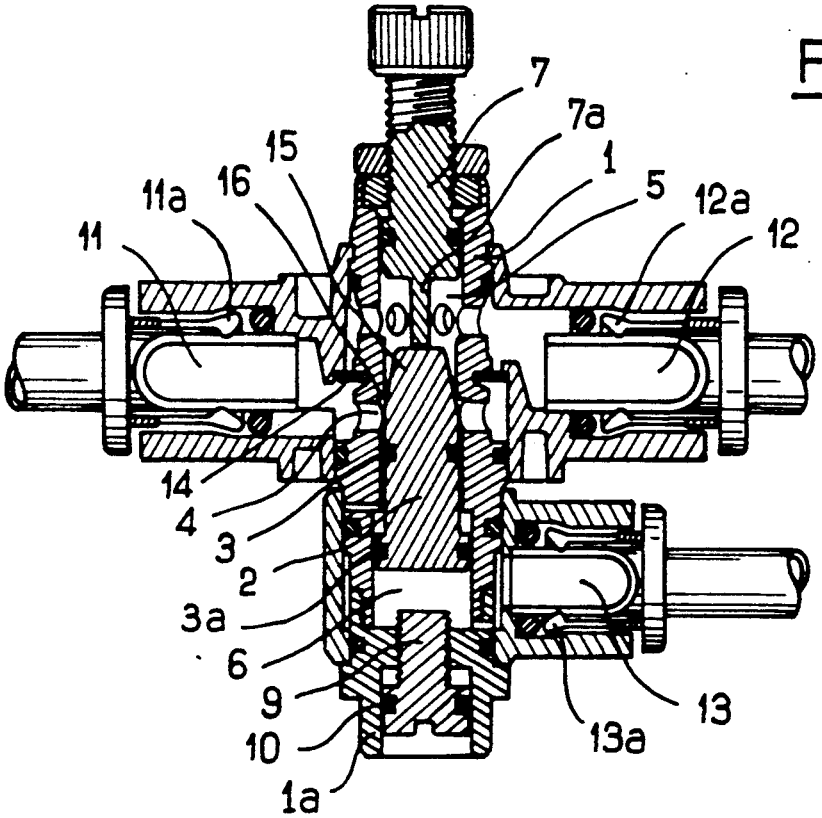
FIG. 4 is a section view of another embodiment of the invention.

FIG. 4 shows in section another embodiment of a controlled two-speed connector-adjuster in accordance with the invention. In FIG. 4 and conversely to the arrangement of the embodiments described with reference to FIGS. 1, 2 and 3, the arrangement of piston 2 is here such that it tends to close seat 16 in the direction of escaping air flow, namely from chamber 4 to chamber 5; this arrangement is more especially applicable in small sized apparatus.

In FIGS. 1, 2, 3 and 4, the adjustment screw 7 for the low speed comprises a left-hand thread and the adjustment screw 9 for the high speed a right-hand thread.

In FIGS. 1, 2, 3 and 4, the orifices 11, 12 and 13 are equipped with quick-fit connection cartridges 11*a*, 12*a* and 13*a*.

Of course, the present invention is not limitative and a man skilled in the art may make modifications thereto without departing from the scope of the invention.

I claim:

1. Connector-adjuster for adjusting the speed of a pneumatic pressure cylinder comprising body containing a first chamber communicating with a first orifice to be connected to the pressure cylinder and a second chamber communicating with a second orifice to be connected to directional control valves, the first and second chambers communicating by a first passage provided with a unidirectional valve for full flow of the drive fluid from the second chamber towards the first chamber and by a second passage defined between a seat and a needle valve for escapement of fluid from the cylinder the needle valve constituting an end of a piston sliding sealingly in a cylindrical housing by means of a seal between a first position close to the seat and a second position further away from the seat, the two positions defining two values for the second passage, and the piston further defining in the cylindrical housing, opposite the needle valve, a third chamber with an orifice for connection to a pipe through which arrives a pneumatic control signal, the control signal acting on the face of the pistion opposite the needle valve for driving it towards closure of the seat or first position, and a stop being axially adjustable in position from an exterior for abutting against the end of the needle valve determining the stroke of the piston for closure of the seat, wherein the stop limiting the stroke of the piston during closure of the seat is formed by a screw coaxial with the piston screwed into the body sealingly via an O-seal, and extended in the direction of the needle valve by a rod on an end of which the piston abuts in a closure stoke.

2. Connector-adjuster for adjusting the speed of a pneumatic pressure cylinder comprising body containing a first chamber communicating with a first orifice to be connected to the pressure cylinder and a second chamber communicating with a second orifice to be connected to directional control valves, the first and second chambers communicating by a first passage provided with a unidirectional valve for full flow of the drive fluid from the second chamber towards the first chamber and by a second passage defined between a seat and a needle valve for escapement of fluid from the cylinder the needle valve constituting an end of a piston sliding sealingly in a cylindrical housing by means of a seal between a first position close to the seat and a second position further away from the seat, the two positions defining two values for the second passage, and the piston further defining in the cylindrical housing, opposite the needle valve, a third chamber with an orifice for connection to a pipe through which arrives a pneumatic control signal, the control signal acting on the face of the piston opposite the needle valve for driving it towards closure of the seat or first position, and a stop being axially adjustable in position from an exterior for abutting against the end of the needle valve determining the stroke of the piston for closure of the seat.

wherein the piston is a stepped piston having two different sections defined as a small section and a large section, each of the two sections being equipped with an O-seal, the small section defined by the seal on a side of the needle valve being subjected to the pressure passing through the apparatus from the one to the other of the orifices and the large section defined by the seal being subjected to the pressure of the control signal in the third chamber.

3. Connector-adjuster for adjusting the speed of a pneumatic pressure cylinder comprising body containing a first chamber communicating with a first orifice to be connected to the pressure cylinder and a second chamber communicating with a second orifice to be connected to directional control valves, the first and second chambers communicating by a first passage provided with a unidirectional valve for full flow of the drive fluid from the second chamber towards the first chamber and by a second passage defined between a seat and a needle valve for escapement of fluid from the cylinder the needle valve constituting an end of a piston sliding sealingly in a cylindrical housing by means of a seal between a first position close to the seat and a second position further away from the seat, the two positions defining two values for the second passage, and the piston further defining in the cylindrical housing, opposite the needle valve, a third chamber with an orifice for connection to a pipe through which arrives a pneumatic control signal, the control signal acting on the face of the piston opposite the needle valve for driving it towards closure of the seat or first position, and a stop being axially adjustable in position from an exterior for abutting against the end of the needle valve determining the stroke of the piston for closure of the seat, wherein the needle valve of the piston is extended beyond the seat by a small diameter rod having at an end a part the section thereof is smaller than that of the seat and than that of the part, of the piston, equipped with the seal, the smaller section subjected to the pressure in the chamber sliding sealingly by means of an O-seal in the cylindrical housing of the body, and the stroke of the piston during clousre of the seat by the needle valve being limited by abutment of said section on an internal end of an adjustment screw in an extension of the cylindrical housing.

4. Connector-adjuster for adjusting the speed of a pneumatic pressure cylinder comprising body containing a first chamber communicating with a first orifice to be connected to the pressure cylinder and a second chamber communicating with a second orifice to be connected to directional control valves, the first and second chambers communicating by a first passage provided with a unidirectional valve for full flow of the drive fluid from the second chamber towards the first chamber and by a second passage defined between a seat and a needle valve for escapement of fluid from the cylinder the needle valve constituting an end of a piston sliding sealingly in a cylindrical housing by means of a seal between a first position close to the seat and a second position further away from the seat, the two positions defining two values for the second passage, and the piston further defining in the cylindrical housing, opposite the needle valve, a third chamber with an orifice for connection to a pipe through which arrives a pneumatic control signal, the control signal acting on the face of the piston opposite the needle valve for driving it towards closure of the seat or first position, and a stop being axially adjustable in position from an exterior for abutting against the end of the needle valve determining the stroke of the piston for closure of the seat, wherein the stroke of the piston during closure of the seat is defined by a position of an internal end in the third chamber of a screw which is adjustable from outside and is sealed by means of an O-seal into a plug fast with the body and the piston abuts an end opposite the needle valve.

5. Connector-adjuster according to claim 1 or claim 3 wherein the screw for adjusting the stroke of the piston during closure of the seat comprises a left-handed thread.

6. Connector-adjuster according to claims 1 or 2 or 3 or 4 wherein the orifices for connecting the apparatus by means of pipe are equipped with quick-fit connection cartridges.

7. Connector-adjuster for adjusting the speed of a pneumatic pressure cylinder comprising body containing a first chamber communicating with a first orifice to be connected to the pressure cylinder, and a second chamber communicating with a second orifice to be connected to directional control valves, the first and second chambers communicating by a first passage provided with a unidirectional valve for full flow of the drive fluid from the second chamber towards the first chamber and by a second passage defined between a seat and a needle valve for escapement of fluid from the cylinder, the needle valve constituting an end of a piston sliding sealingly in a cylindrical housing by means of a seal between a first position close to the seat and a second position further away from the seat, the two positions defining two values for the second passage, the piston further defining in the cylindrical housing, opposite the needle valve, a third chamber with an orifice for connection to a pipe through which arrives a pneumatic control signal, the control signal acting on the face of the piston opposite the needle valve for driving it towards closure of the seat or first position, a stop being axially adjustable in position from an exterior and abutting against the end of the needle valve determining the stroke of the piston for closure of the seat, and the stop limiting the stroke of the piston during closure of the seat is formed by a screw coaxial with the piston screwed into the body sealingly via an O-seal, and extended in the direction of the needle valve by a rod on an end of which the piston abuts in a closure stroke.

8. Connector-adjuster for adjusting the speed of a pneumatic pressure cylinder comprising body containing a first chamber communicating with a first orifice to be connected to the pressure cylinder, and a second chamber communicating with a second orifice to be connected to directional control valves, the first and second chambers communicating by a first passage provided with a unidirectional valve for full flow of the drive fluid of the drive fluid from the second chamber towards the first chamber and by a second passage defined between a seat and a needle valve for escapement of fluid from the cylinder, the needle valve constituting an end of a piston sliding sealingly in a cylindrical housing by means of a seal between a first position close to the seat and a second position further away from the seat, the two positions defining two values for the second passage, the piston further defining in the cylindrical housing, opposite the needle valve, a third chamber with an orifice for connection to a pipe through which arrives a pneumatic control signal, the control signal acting on the face of the piston opposite the needle valve for driving it towards closure of the seat or first position, a stop being axially adjustable in position from an exterior for abutting against the end of the needle valve determining the stroke of the piston for closure of the seat, the needle valve of the piston is extended beyond the seat by a small diameter rod having at an end of a smaller section than that of the seat and the smaller section equipped with the seal, the smaller section subjected to the pressure in the chamber sliding sealingly by means of an O-seal in the cylindrical housing of the body, and the stroke of the piston during closure of the seat by the needle valve being limited by abutment of said section on an internal end of an adjustment screw in an extension of the cylindrical housing

* * * * *